US009574805B2

(12) United States Patent
Yang et al.

(10) Patent No.: US 9,574,805 B2
(45) Date of Patent: Feb. 21, 2017

(54) MOTOR HOUSING TEMPERATURE CONTROL SYSTEM

(71) Applicant: JOHNSON CONTROLS TECHNOLOGY COMPANY, Holland, MI (US)

(72) Inventors: Liming Yang, Seven Valleys, PA (US); Curtis Christian Crane, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 0 days.

(21) Appl. No.: 15/026,547

(22) PCT Filed: Sep. 24, 2014

(86) PCT No.: PCT/US2014/057103

§ 371 (c)(1),
(2) Date: Mar. 31, 2016

(87) PCT Pub. No.: WO2015/053939

PCT Pub. Date: Apr. 16, 2015

(65) Prior Publication Data

US 2016/0245559 A1 Aug. 25, 2016

Related U.S. Application Data

(60) Provisional application No. 61/888,566, filed on Oct. 9, 2013.

(51) Int. Cl.

| | |
|---|---|
| ***G05D 23/32*** | (2006.01) |
| ***F25D 17/00*** | (2006.01) |
| ***F25B 41/00*** | (2006.01) |
| ***F25B 41/04*** | (2006.01) |
| ***F25B 31/00*** | (2006.01) |

(52) U.S. Cl.
CPC ..... *F25B 31/006* (2013.01)

(58) Field of Classification Search
CPC ..... F04C 29/045; F25B 31/006
USPC ..... 62/180, 158, 196.1, 204
See application file for complete search history.

(56) References Cited

U.S. PATENT DOCUMENTS

| | | | | |
|---|---|---|---|---|
| 3,727,420 A * | 4/1973 | Kosfeld | F25B 31/006 | 62/196.1 |
| 3,753,043 A * | 8/1973 | Plouffe | H02H 5/086 | 361/22 |
| 4,248,053 A * | 2/1981 | Sisk | F04B 49/126 | 236/1 E |

(Continued)

FOREIGN PATENT DOCUMENTS

WO 2013/039572 A1 3/2013

*Primary Examiner* — Henry Crenshaw
(74) *Attorney, Agent, or Firm* — Fletcher Yoder, P.C.

(57) ABSTRACT

A method and apparatus for controlling temperature of a compressor motor (170) having a motor cooling circuit in a refrigeration system (1014) is provided. The motor cooling circuit includes a second expansion valve (1043) providing fluid communication between the condenser and the compressor motor. The compressor motor (170) is in fluid communication with the refrigeration circuit (1014) between downstream of the first expansion valve (1040) and a compressor inlet. Refrigerant is provided as a cooling fluid to the motor cooling circuit. A primary PID loop (402) and a secondary PID loop (414) are used to control the temperature and the flow of refrigerant to the motor (170).

16 Claims, 5 Drawing Sheets

(56) References Cited

U.S. PATENT DOCUMENTS

| | | | | | |
|---|---|---|---|---|---|
| 5,255,530 | A * | 10/1993 | Janke | F25B 49/025 | 62/180 |
| 5,316,074 | A * | 5/1994 | Isaji | B60H 1/00392 | 165/43 |
| 5,460,009 | A * | 10/1995 | Wills | F25B 47/025 | 62/180 |
| 5,950,443 | A * | 9/1999 | Meyer | F04C 28/00 | 417/292 |
| 6,020,702 | A * | 2/2000 | Farr | F25B 49/025 | 318/434 |
| 6,032,472 | A | 3/2000 | Heinrichs et al. | | |
| 6,324,858 | B1 | 12/2001 | Holden | | |
| 6,837,217 | B1 * | 1/2005 | Hoshino | F02D 11/105 | 123/399 |
| 2007/0144193 | A1 * | 6/2007 | Crane | F25B 49/022 | 62/228.4 |
| 2011/0043156 | A1 * | 2/2011 | Powell | F04D 27/0261 | 318/566 |

* cited by examiner

MOTOR HOUSING TEMPERATURE CONTROL SYSTEM

FIELD OF THE INVENTION

The present invention is generally directed to system for control of motor temperature, and more specifically, to control of compressor motor housing temperature in a cooled motor.

BACKGROUND OF THE INVENTION

Recent changes in compressor design have suggested a need for changes in how motor temperature is controlled. Past methods for control of motor temperature have used a Proportional Integral Derivative (PID) control system to control the system motor temperature. The traditional PID control system monitors the temperature of the motor housing to control the system motor temperature. The traditional PID control system is used to control a valve which provides a coolant into the motor to cool the motor when the temperature exceeds a preselected set point. In one system, the motor is used to operate a compressor, and the coolant is refrigerant. When the valve is an electronic expansion valve (EEV), the valve operates to expand liquid refrigerant, lowering the pressure and the temperature of the refrigerant, so that a mist enters the motor for purposes of cooling. The PID control system monitors the temperature of the motor housing to determine whether a preselected set point is reached, and signals for an opening of the valve when the set point is reached, and closes the valve, thereby restricting the flow of cooling fluid into the motor when the temperature is below the set point.

Recent advances in compressor design have resulted in larger compressors. These larger compressors have larger motors with resulting larger motor housings. The larger motors also have resulted in increased heat generated by the motors, while the additional mass that has been added to the larger motor housings has increased the heat capacity of the motor systems. In addition, some of these compressor designs have incorporated electromagnetic (EM) bearings to balance the rotor during operation, which generate additional heat within the motor housing. In some designs, the materials used for the motor housings have changed. So, in those designs in which larger cast iron motor housings have been substituted for smaller aluminum or aluminum alloy motor housings, not only has the mass of the motor housings changed, but the thermal conductivity of the housings has changed, the aluminum and aluminum alloy and copper and copper alloy motor housings having a higher thermal conductivity than the cast iron motor housings. Generally, cast iron also has a lower specific heat capacity than aluminum, by a factor of two. This means that for a system having the same material mass and the same heat input, a cast iron housing will increase in temperature at about twice the rate as an aluminum housing. Clearly, systems having larger motors, larger motor housings made from materials with lower thermal conductivity and that incorporate additional sources of heat, such as EM bearings will be less responsive to cooling based on changes in motor housing temperature. As used herein, the combination of thermal conductivity, component (motor housing) mass, specific heat capacity of the component mass and heat generated within the component is used herein to refer to the thermal inertia of the system. Recent compressor advances utilizing larger, cast iron motor housings and larger motors are defined herein as high thermal inertia systems because of their slower rate of heating and cooling, and may also include EM bearings, while prior art systems utilizing aluminum, aluminum alloy, copper or copper motor housings, smaller motors utilizing small cast iron motor housings and mechanical bearings are defined herein as low thermal inertia systems, which tend to be more responsive to cooling, when identical cooling designs are utilized in the high inertia and low inertia system. When two systems have the same mass but utilize different materials for the motor housing, such as cast iron and aluminum alloy, the aluminum alloy system, being the low thermal inertia system, will respond more quickly to temperature changes when identical cooling systems are utilized.

As motor sizes increase while more cost effective materials in the form of high thermal inertia materials are incorporated into the design, what is needed is a control scheme that is more responsive to changes in motor temperature in a system having a high thermal inertia than current control schemes used in low thermal inertia systems.

SUMMARY OF THE INVENTION

The present invention comprises a turbomachine having a shaft rotated by a motor. The motor includes a stator and a rotor, the rotor residing within a motor housing and the rotor connected to the turbomachine shaft. The motor also includes bearings for centering the rotor and attached shaft within the turbomachine. The motor and the motor housing are cooled by a fluid circulated within the motor housing. In the present invention, fluid is circulated into the motor and is controlled by a valve, such as an electronic expansion valve (EEV). The EEV is controlled by a controller that provides a signal to regulate the valve position. In the present invention, the signal transmitted by the controller to the valve is in response to measured temperatures measured transmitted to the controller.

At least one of the measured temperatures transmitted to the controller is associated with the stator. The measured temperature associated with the stator is the stator control temperature corresponding to the winding temperature set point of the stator motor windings, $T_{windingspt}$, which is set by a primary PID controller. The stator control temperature also is monitored by a secondary PID controller, which controls the position of the EEV regulating the amount of cooling fluid through the motor housing. The cooling fluid flow will cool down or restricted flow thereof will allow the motor housing to heat up to bring the stator winding temperature to the set point $T_{windingspt}$. The primary PID controller monitors the motor housing temperature, $T_{housing}$, and determines the appropriate winding temperature set point, $T_{windingspt}$. $T_{housing}$ is the actual temperature of the motor housing measured by a thermocouple, thermistor or other temperature sensor. $T_{windingspt}$ is a setpoint calculated by the primary PID controller based on the measured motor housing temperature and its setpoint. A signal indicative of the appropriate winding temperature set point, $T_{windingspt}$, is then sent from the primary PID controller to the secondary PID controller. Because the stator winding temperature and motor housing temperature are correlated, the primary PID allows the motor housing temperature, $T_{housing}$, to approach the motor housing set point, $T_{housingspt}$, by raising or lowering the stator winding temperature setpoint, $T_{windingspt}$, of the secondary PID, which in turn regulates the amount of cooling fluid through the EEV to the motor housing, which includes the stator. When the secondary PID controller is set properly, both the motor housing temperature $T_{housing}$ and the stator winding temperature $T_{winding}$ should have corresponding set points or set points that, if not corresponding, should approach one another closely at or near equilibrium.

The use of the stator temperature $T_{winding}$ by the secondary PID controller to control cooling fluid flow into the compressor motor is useful in overcoming the high thermal inertia in a system when the chiller head is high As used herein, a high chiller head means that there is a large pressure differential between the condenser and evaporator. A higher head can drive more cooling refrigerant to the motor housing when the EEV is opened at the same position by comparison with a lower head. The head of the chiller varies with chiller operating conditions. When the head is high the stator temperature will respond to EEV position changes much more quickly than will the motor housing temperature.

In a high thermal inertia system, the motor housing responds slowly as a result of heating and cooling, so the use of the motor housing temperature, $T_{housing}$, to control coolant flow into the motor can result in high stator temperatures during heating. This is generally undesirable, since such high stator temperatures can reduce the operating life of the stator.

Conversely, in the high thermal inertia system, the slow response of the motor housing and motor housing temperature as coolant flow cools the motor housing can result in low overshoot motor housing temperatures, which is also undesirable since such low temperatures can result in moisture condensation from the atmosphere onto the exterior of the motor housing.

A signal indicative of the motor housing temperature, $T_{housing}$, is provided by the motor housing temperature sensor to the first PID controller. This measured motor housing temperature is compared by the first PID controller to the programmed motor housing setpoint. Based on this temperature differential, which may be predetermined, the first PID controller may provide a signal to the second PID controller to either maintain the stator winding temperature setpoint $T_{windingspt}$ or to modify it, the stator winding temperature setpoint, $T_{windingspt}$, being dynamically calculated and modified as required by the first PID controller based on a signal from the motor housing temperature sensor indicative of the motor housing temperature, $T_{housing}$, and its variance from the motor housing temperature setpoint, $T_{windingspt}$, as a result of controlling the winding temperature to its setpoint. The algorithm used to dynamically determine $T_{windingspt}$ may be firmware or software programmed into the first PID.

The system and method for controlling temperature of a compressor motor having a motor cooling circuit in a refrigeration system may be a hybrid of the previously described system. When the chiller head is high, the use of the motor winding temperature and motor housing temperature to control cooling flow to the motor is effective in controlling the motor housing temperature due to the thermal inertia of the housing. However, when the chiller head is low, the actual motor housing temperature is more effective to control cooling flow to the motor to control motor housing temperature, as the windings temperature responds slowly, if at all, to the EEV position. While the EEV still controls the flow of coolant to the motor, the control of the EEV may be determined either by the motor housing temperature, $T_{housing}$, or the motor winding temperature and motor housing temperature.

In this circumstance (low head), the winding temperature, $T_{winding}$ is monitored and input to the secondary PID of the cascade control. The motor housing temperature, $T_{housing}$, is input to the primary PID of the cascade control or standalone PID. The system also includes sensors to monitor pressures at the condenser and the evaporator, a signal indicative of the pressures being sent to the control system, which also includes software to monitor system head based on the received signals. The control system includes programmable set points for the head differential as well as a preset time within the head differential. When the head differential exceeds the preset set point for a preset time, indicative of high head, the control system uses the cascade PID control to control the EEV. Thus, $T_{winding}$ and its relationship to $T_{windingspt}$ effectively controls the flow of cooling refrigerant through EEV and effectively precludes overheating of the system due to the thermal inertia of the system. However, when signals from the sensors indicate that the head differential has not exceeded the programmable set points for a predetermined period of time indicative of a low head situation wherein the cascade control may be unstable, then $T_{housing}$ is used to control the flow of refrigerant through the EEV. In this circumstance, the standalone PID is used to control the flow of refrigerant through the EEV, so that $T_{housing}$ effectively controls the amount of refrigerant flowing through the EEV.

An advantage to using a hybrid system in which either $T_{housing}$ or $T_{winding}$ and $T_{housing}$ is used to control the EEV and cooling flow of refrigerant to the motor is that control over the motor temperature is provided over the full range of the chiller operating head range.

The hybrid system provides temperature control of the compressor motor using the stator winding temperature when chiller operating head is high and the thermal inertia of the system precludes proper temperature control of the motor by monitoring the temperature of the motor housing.

The hybrid system also advantageously provides temperature control of the compressor using the motor housing temperature when chiller operating head is low.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The present invention provides a system for control of motor temperature. In particularly, the system controls compressor motor housing temperature using a motor cooling circuit employing refrigerant. The system is particularly effective in a motor having high thermal inertia.

Figure 1:
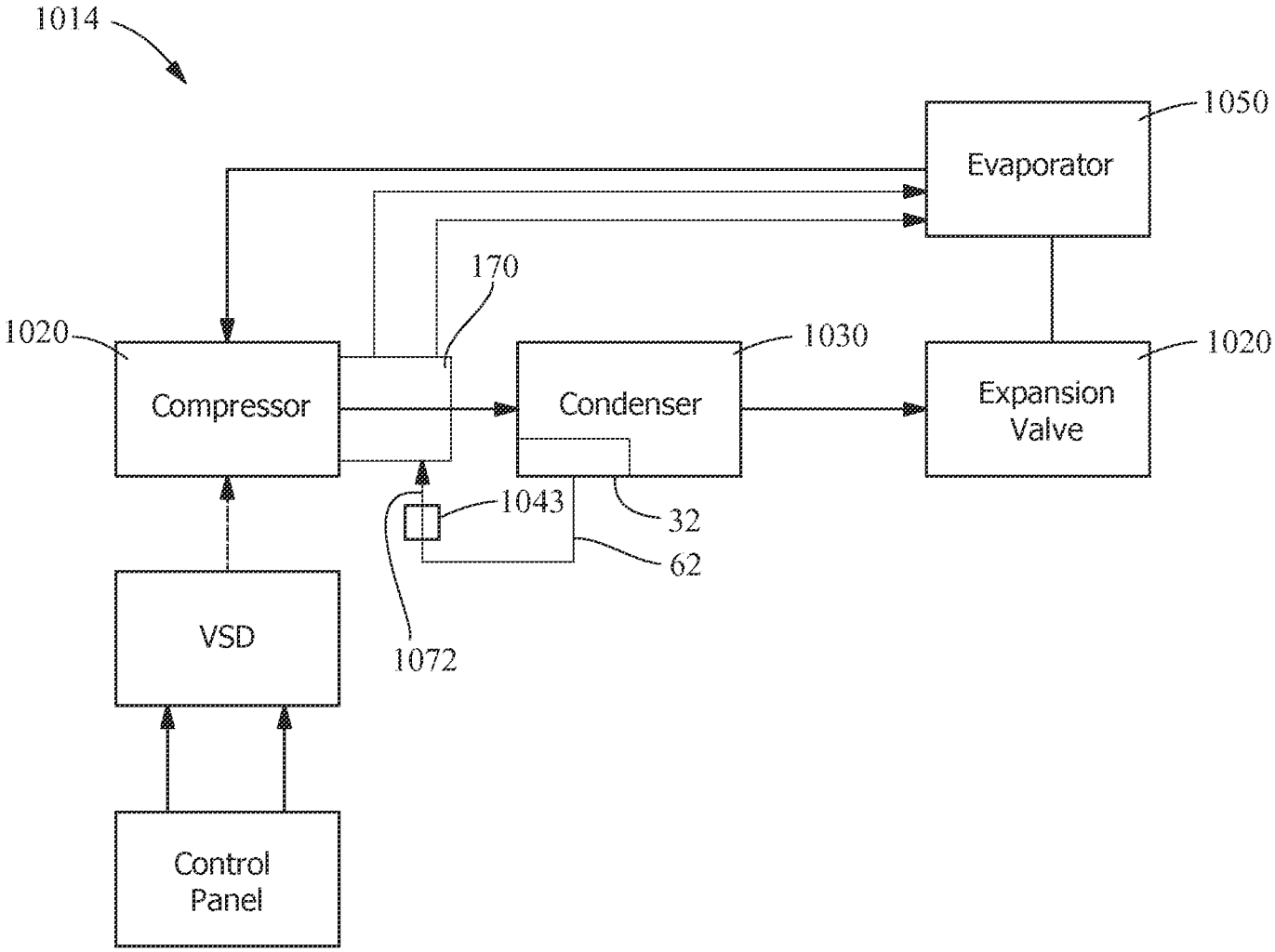
FIG. 1 depicts a schematic for a refrigerant system that utilizes refrigerant from the condenser to cool the compressor.

FIG. 1 depicts a cooling system 1014 that utilizes a compressor 1020 such as used in the present invention. The invention is not limited to a particular type of compressor, as any compressor may advantageously be cooled by the arrangement of hardware and methods set forth herein, including but not limited to screw compressors, centrifugal compressors, scroll compressors and reciprocating compressors. Compressor 1020 compresses the working fluid, which is refrigerant, that enters the compressor inlet as a gas, raising the temperature of the refrigerant gas as it is compressed. The pressurized, high temperature refrigerant gas then flows to a condenser 1030 where the high pressure refrigerant gas is condensed to a high pressure liquid. A cooling tower, not shown, may be used to remove heat from the condensed fluid, as is well-known. The refrigerant liquid then flows to a first expansion device 1040. In this invention, a portion of the refrigerant liquid from the condenser does not flow to first expansion device. Instead, it is used to cool the motor, as will be explained. Refrigerant liquid that does flow through first expansion device 1040 expands into a reduced pressure, reduced temperature mist and then flows to evaporator 1050 or cooler. Evaporator/cooler may have a chiller, as is well known, not shown, associated with it, the fluid circulating to the chiller being chilled as the refrigerant mist, a mixture of gas and liquid, evaporates in evaporator 1050 undergoing a phase change from liquid to gas. The chilled liquid then may be used to cool a space, such as the interior of a building. Alternatively, in some systems, fluid in the form of air from the space being cooled passes over evaporator 1050 and is cooled directly as the evaporating liquid changes phase from liquid/mist to gas. The refrigerant gas is drawn back to the compressor 1020, and the cycle repeats.

Some of the liquid refrigerant from condenser 1030 is sent to a circuit that cools a compressor motor 170. As depicted in FIG. 1, liquid refrigerant from condenser flows through a second expansion device 1043 where the liquid refrigerant is converted into a low temperature mist. The refrigerant mist then is sent to compressor motor 170 where it is used to cool the motor, the liquid portion of the mist drawing heat from the compressor motor as it evaporates, undergoing a phase change. As is shown in FIG. 1, any liquid refrigerant that is not evaporated is sent from the motor 170 of compressor 1020 back to evaporator 1050 where it evaporates. Refrigerant gas from the compressor motor 170 may be returned to the refrigeration circuit at any point from the evaporator 1050 to the gas refrigerant inlet of compressor 1020. In FIG. 1, refrigerant gas and refrigerant liquid from compressor motor 170 are shown being returned to evaporator 1050 via separate lines.

Figure 2:
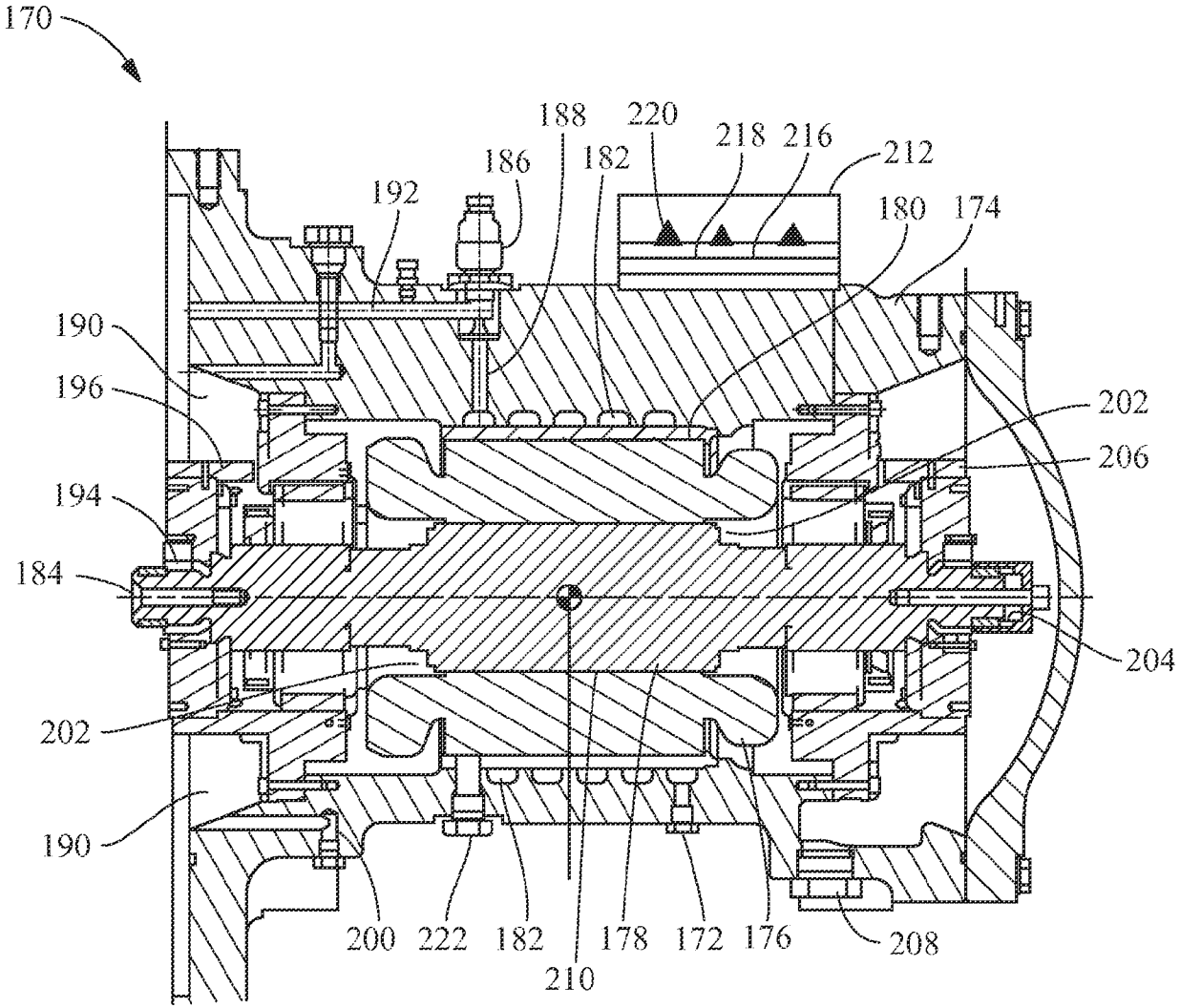
FIG. 2 depicts a motor for a compressor of the refrigerant system of FIG. 1 and the cooling path associated with the compressor motor.

A cross-sectional representation of a motor 170 such as may be cooled by the present invention is depicted in FIG. 2. The motor depicted is representative of a motor that may be used to drive, for example, a centrifugal compressor, but the use of the motor is not so restricted, as such motors are used to drive other compressors, such as, for example, scroll compressors and screw compressors. Motor 170 may be used in the refrigeration circuit 1014 depicted in FIG. 1. Motor 170 resides within a housing 174. Housing 174 for large motors most cost-effectively are iron castings. Gray cast iron provides a vibration resistant housing although ductile iron, which is not as cost efficient as gray cast iron, may also be used. Non-ferrous alloys for the large housing component significantly may add cost to the motor while having inferior mechanical properties. However, motors having housings made of the non-ferrous materials aluminum, copper and alloys of aluminum and copper may be lighter in weight while providing better heat transfer properties than the cast iron housings, making these alloys the preferred engineering selection for applications in which thermal response and thermal control are of importance.

Still referring to FIG. 2, within housing 174 is a stator 176 and a rotor 178, rotor 178 positioned within stator 176. Stator 176 customarily comprises copper windings around a ferromagnetic core material, typically laminated steel. Stator 176 and rotor 178 may be hermetically sealed within housing 174. An optional spacer 180 is positioned between housing 174 and stator 176, optional spacer 180 being a cylinder extending 360 degrees around stator 176 and used to restrict cooling fluid (refrigerant) flow when desired. A compressor, such as compressor 1020, FIG. 1, may be attached to rotor 178 at attachment position 184 of FIG. 2. As shown, when compressor 1020 is a centrifugal compressor, the impeller of the compressor may be bolted to rotor 178 so that the axis of the impeller is coincident with the axis of the rotor, the rotor turning the impeller shaft and the impeller. Any other known method of attaching a compressor to the motor may be used. Although a preferred compressor is a centrifugal compressor, any other rotating compressor may be used with motor 170 of the present invention. Thus, motor 170 would also find use particularly with a scroll compressor design or a screw compressor design as well as a centrifugal compressor design.

Housing 174 includes a helical annulus 182 that is in fluid communication with inlet 172 to motor 170, as shown in FIG. 2, providing a fluid passageway. Helical annulus 182 extends within housing opposite optional spacer 180. As refrigerant fluid enters motor 170 through inlet 172, refrigerant flows through helical annulus contacting both housing 174 and spacer 180, when spacer 180 is present. When spacer 180 is not present, refrigerant flow also may be in direct contact with stator 176. When stator 176 is energized and coolant flow is activated, the refrigerant, which flows into motor housing 174, absorbs heat from stator 176, as the flowing refrigerant is at a lower temperature than the operating stator. Depending upon whether optional spacer 180 is utilized, flowing refrigerant may or may not physically contact stator 176. Regardless as to whether spacer 180 is used, refrigerant draws heat away from stator 176 as liquid portion of the refrigerant mist is converted to gas. Spacer 180 may be used to prevent the refrigerant from creating a permanent leak path through stator 176, as refrigerant may leak through any gaps between stator laminations, thereby adversely affecting compressor efficiency by bypassing refrigerant from the condenser to the evaporator in excess of the amount needed for motor cooling when no leak paths are present. When optional spacer 180 is utilized, the flowing refrigerant through helical annulus 182 will instead contact spacer 180, which will conduct heat from stator 176 to the refrigerant. Optional spacer 180 preferably is fabricated from a highly thermally conductive material, alternatively stated, as a material with a high coefficient of thermal conductivity. Copper, aluminum and alloys of copper or aluminum are preferred materials of construction for the optional spacer.

Stator 176 comprises copper wire windings around a permanent magnet core, preferably an iron-based alloy or steel, as discussed above. When optional spacer 180 is utilized, it is attached to stator 176 by a shrink fit, utilizing any effective and well-known shrink-fit method. Spacer 180 with stator 176 may be prevented from rotating or moving axially relative to housing 174 by means of an alignment pin 222 engaging housing 174, spacer 180 and stator 176. Alignment pin 222 preferably includes a seal to prevent leakage of refrigerant across the pressure boundary formed by the housing.

Also shown in FIG. 2 is an optional electronics enclosure 212 or box mounted on motor housing 174. Electronics enclosure 212 houses one or more circuit boards 218 to which electronic components 220 are mounted or otherwise houses electronics. When motor 170 is in operation, electronic components 220 generate a significant amount of heat that must be removed from electronics enclosure 212 to prevent damage to the components from heat buildup. To prevent this damage, heat is conducted through the bottom of enclosure 212. While heat also may be conducted through the sides of enclosure 212, the space in which motor 170 is mounted may itself be subject to heat build-up which precludes effective cooling from the surrounding ambient atmosphere. To provide effective, reliable cooling for electronics mounted on motor housing, heat efficiently may be transferred primarily through enclosure 212 and into housing 174, to refrigerant. Thus, mounting of electronics onto motor housing 174, as is typical, provides still another source of heat to a high thermal inertia motor.

The physical transfer of heat from circuit boards 218 to housing 174 may be accomplished by any number of methods, but the ultimate mechanism for the transfer of heat generated within electronics enclosure 212 is by conduction from electronics enclosure 212, such as from boards 218, to refrigerant flowing through motor housing 174.

For a horizontally mounted motor, as depicted in FIG. 2, after passing through motor housing 174, some of the refrigerant mist may remain as a liquid and will fall by gravity to base of motor cavity 190. It will be understood that for a vertically mounted compressor, refrigerant liquid also will fall by gravity to a location where it can be captured. The liquid then flows to liquid outlet 200. Refrigerant liquid from liquid outlet 200 may then flow to evaporator 1050 through a connecting conduit (not shown) in fluid communication with evaporator 1050. Condenser 1030 is on the high pressure side of the refrigeration circuit, evaporator 1050 is on the low pressure side of the refrigeration circuit and refrigerant flowing to cool compressor motor 170 is at a pressure intermediate between condenser 1030 and evaporator 1050 pressures, so the pressure differential between condenser 1030 and evaporator 1050 drives the refrigerant flow through motor 170.

In FIG. 2, refrigerant remaining in motor 170 is then drawn through stator/rotor annulus 202, which is the gap between stator 176 and rotor 178. Refrigerant passing through stator/rotor annulus then passes over EM bearings 206 and mechanical backup bearings 204 within motor housing 174 when motor 170 is so equipped. Refrigerant gas then passes through vent 208 and is returned to the refrigerant circuit, preferably at some entry point from the compressor inlet to and including evaporator 1050.

Figure 3:
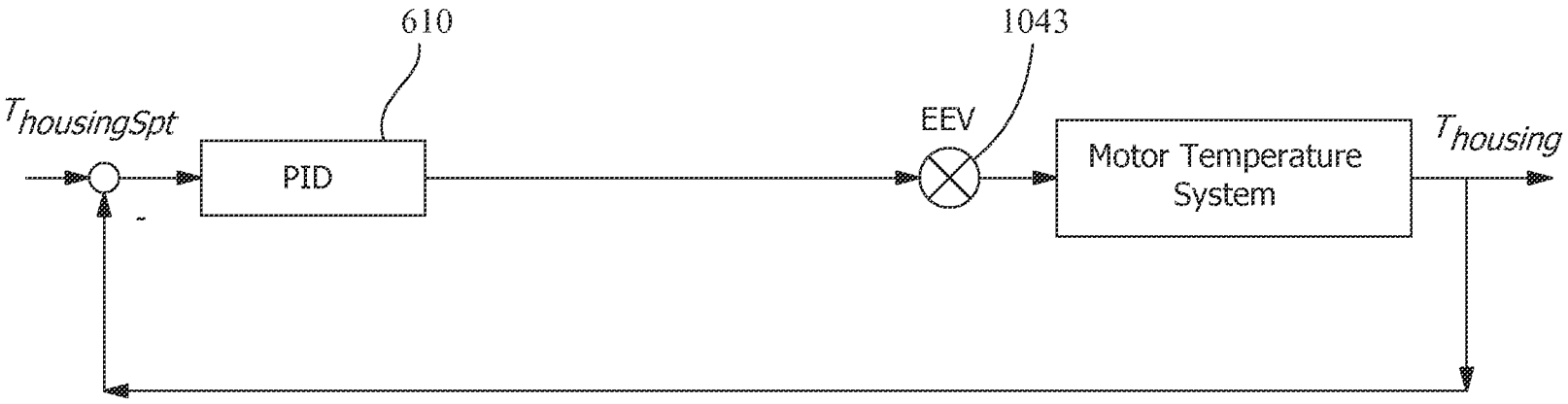
FIG. 3 PRIOR ART
FIG. 3 depicts a prior art system for controlling motor temperature.

The coolant flow from condenser 1030 through expansion device 1043 and into motor housing through motor inlet 172 is used to control the motor temperature. A prior art method, set forth schematically in FIG. 3, is used solely to monitor motor housing temperature. This system still is used and is effective for monitoring motor temperature for low thermal inertia systems. However, this system becomes sluggish in reacting as the thermal inertia of the system increases. A temperature measurement device such as a sensor mounted on the motor housing is used to monitor the motor temperature. At least one temperature sensor is mounted on an interior wall of housing 174. This measured temperature is provided to a separate PID control system or a PID module usually within the system controller, the PID control system or module within the system controller hereinafter referred to as the PID controller and labeled as 610 in FIG. 3. When the measured temperature of the motor housing $T_{housing}$, deviates from a predetermined temperature housing set point, $T_{housingspt}$, stored in PID controller 610, PID controller 610 regulates refrigerant flow through EEV 1043 into motor inlet 172 to maintain motor housing temperature $T_{housing}$ at or below its set point. The flow of refrigerant may vary from no flow to maximum flow or modulated at intermediate flow rates, depending on the measured temperature. It will be understood that $T_{housingspt}$ may include a temperature tolerance or a temperature range such that once cooling flow has been initiated by reaching the high end of the tolerance or temperature range, cooling flow will not be restricted until the low end of the temperature tolerance or temperature range has been reached. This is a well known feature that prevents hunting, that is, repetitive cycling of the EEV 1043 resulting in cooling flow for short time intervals. The low end of the temperature tolerance is a temperature selected to prevent overcooling of the housing that can result in condensation forming on the exterior of the motor housing, which can lead to corrosion, particularly when the motor housing comprises a ferrous alloy.

While the prior art method works well for low thermal inertia systems, high thermal inertia systems develop unanticipated problems. When the prior art method set forth in FIG. 3 is used in high thermal inertia systems, the measured motor housing temperature $T_{housing}$ rises slowly precisely due to the high thermal mass of the system. Because the prior art system responds to the measured housing temperature $T_{housing}$, PID controller in the prior art method responds slowly since $T_{housing}$ responses slowly. For example, when the motor load is high, the measured housing temperature, $T_{housing}$ does not rise quickly because of the thermal mass of the system, when the system is a high thermal inertia system. The PID controller in the prior art system only reacts when measured housing temperature $T_{housing}$ achieves the housing set point temperature $T_{housingspt}$. By the time the motor housing set point $T_{housingspt}$ is reached, signaling the opening of EEV 443 to initiate motor cooling, the stator winding temperature $T_{winding}$ will have reached a higher temperature, and possibly unacceptable temperature for an undesirable period of time. Further, this motor housing control system will be unstable if PID gain is increased or integral time is decreased to make it react faster.

Figure 4:
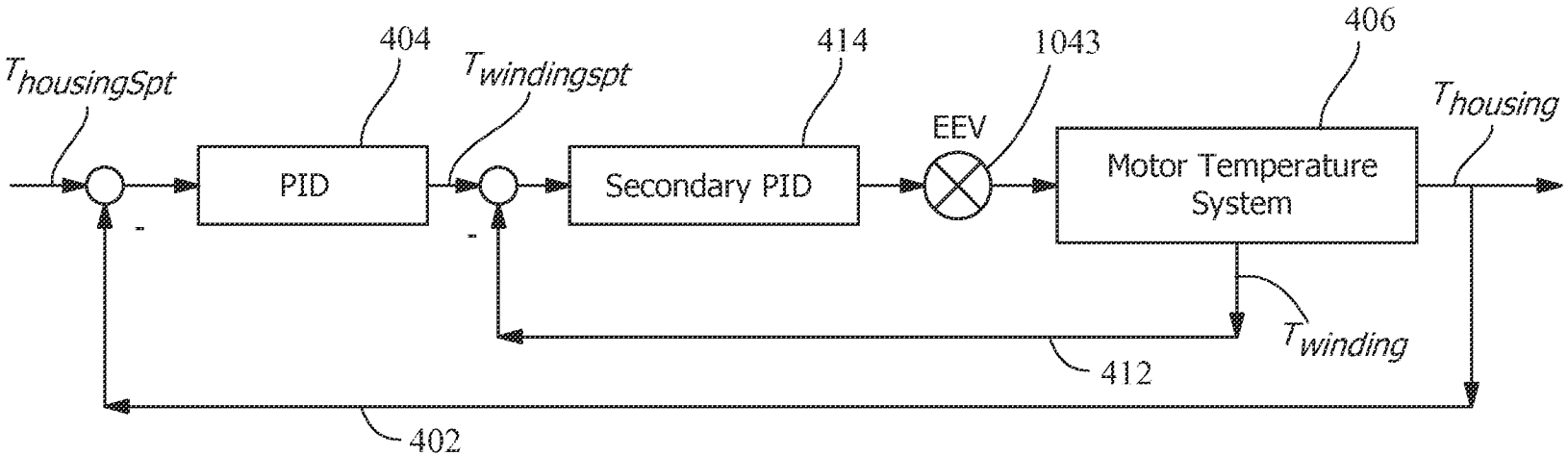
FIG. 4 depicts a control system of the present invention for controlling motor temperature.

The method of the present invention is set forth in FIG. 4, and overcomes the deficiencies with the use of prior art temperature controls as applied to high thermal inertia systems. The control system set forth in FIG. 4 allows the cooling system to react more quickly to stator temperature changes instead of relying solely upon measured motor housing temperature changes.

Referring to FIG. 4, the control system 400 includes a primary control loop 402 that includes a first PID controller 404, motor temperature measurement system 406 as well as a secondary control loop 412 that includes a second PID controller 414 also utilizing motor temperature measurement system 406. As described previously, the first PID controller 404 may be a separate PID control system or a module in a system controller. In a like manner, second PID controller 414 may be a separate PID control system or a separate module in a system controller. In another embodiment, first PID controller 404 and second PID controller may be separate modules in a separate PID control system. The specific arrangement of the PID controllers is not critical to operation or performance of the invention, as long as the separate PID controllers operate independently except as set forth herein.

Referring again to FIG. 4, the control system 400 includes as part of the motor temperature system 406 a temperature sensor that measures the temperature of the stator windings, $T_{winding}$, and a temperature sensor that measures the temperature of the motor housing 174 $T_{housing}$. First PID controller 404 monitors motor housing temperature $T_{housing}$ and may use the measurements from the same temperature sensor in motor temperature system 406 or a different temperature sensor or multiple sensors. First PID controller forms part of a primary loop 402, while secondary PID controller 414 monitors the temperature of the stator winding $T_{winding}$, and forms part of a secondary loop 412. As in the prior art, the motor housing temperature sensor(s) is positioned on an interior surface of motor housing 174. The stator winding temperature sensor measuring $T_{winding}$ is mounted on or within the stator. There may be one or more of either or both the motor housing temperature sensor and the stator winding temperature sensor, and the PIDs 404, 414 can be programmed to react to average temperature readings of either or both the motor temperature sensors and the stator winding temperature sensors, or to a single motor temperature sensor and/or stator winding temperature sensor, for example, that has measured either the highest or lowest temperature value.

In operation, $T_{winding}$ is monitored by second PID controller 414. Second PID controller continuously compares $T_{winding}$ to $T_{windingspt}$. In this system, second PID controller 414 controls EEV 1043 to regulate the supply of refrigerant coolant provided to motor housing 174 through motor housing inlet 172. Because current running through the stator windings will heat the stator quickly, $T_{winding}$ will rise much more quickly than will $T_{housing}$, particularly as the refrigeration system is activated and the motor is heated until steady state heat flow conditions are achieved. As a result, the second PID controller 414 reacts quickly to regulate refrigerant flow as required for cooling. The refrigerant coolant is introduced into motor housing 174 much more quickly in response to the stator winding temperature $T_{winding}$ than in the prior art arrangement depicted in FIG. 3. In addition, once the chiller load decreases, such as from a steady state operation, the stator windings will be cooled more quickly. The second PID controller 414 reacts quickly to stator cooling and controls the EEV 1043 to regulate or stop the flow of refrigerant to motor housing 174. Thus, secondary loop 412 monitoring $T_{winding}$ acts quickly to maintain stator winding temperature at or within a predetermined tolerance of its setpoint $T_{windingspt}$.

First PID controller 404 continues to monitor motor housing temperature $T_{housing}$. As long as measured housing temperature $T_{housing}$ is not at its setpoint $T_{housingspt}$ then refrigerant coolant flow is controlled by second PID controller 414 to control the stator winding temperature $T_{winding}$ to-its setpoint $T_{windingspt}$ while having the ancillary effect of cooling the motor housing so that the motor housing temperature $T_{housing}$ is controlled to its set point $T_{housingspt}$.

As can be seen, in a high thermal inertia system, secondary loop 412 of the present invention acts quickly in response to measured $T_{winding}$. The approach set forth in this invention provides overall faster closed loop control while at the same time maintaining control stability. As a result of quick cooling, stator winding overheating can be prevented, which may increase stator life. In a like manner, the relatively quick heating of the stator windings by secondary loop 412 will prevent overcooling of the motor housing 174 and reduce or substantially eliminate the possibility of condensation on the housing. PID controller 404 provides input to secondary loop 412 and may change $T_{windingspt}$ based on the sensed housing temperature so that the housing does not overcool or overheat by operation of secondary loop 412.

In another embodiment, secondary loop 412 may monitor the amperage drawn by the motor. The second PID controller 414 may be programmed alternatively or in addition to monitor the amperage drawn by the motor at a given motor speed and a temperature. Amperage drawn is related to the temperature of the windings of the stator. When the amperage drawn by the motor exceeds a predetermined value programmed into the second PID controller at a known motor speed, then second PID controller can signal EEV 1043 to open and supply cooling refrigerant to the stator windings. Similarly, EEV 1043 is signaled to close to stop the flow of cooling refrigerant to the stator windings when amperage is at or below a predetermined value. The system works exactly as described above, except that second loop 412 monitors and responds to amperage drawn by the windings instead of or in addition to the temperature of the windings, and signals the EEV in response to one of changes in amperage drawn by the stator windings, changes in the windings temperature, or both, the second PID controller 414 reacting to the first set point of amperage or temperature when exceeded.

Figure 5:
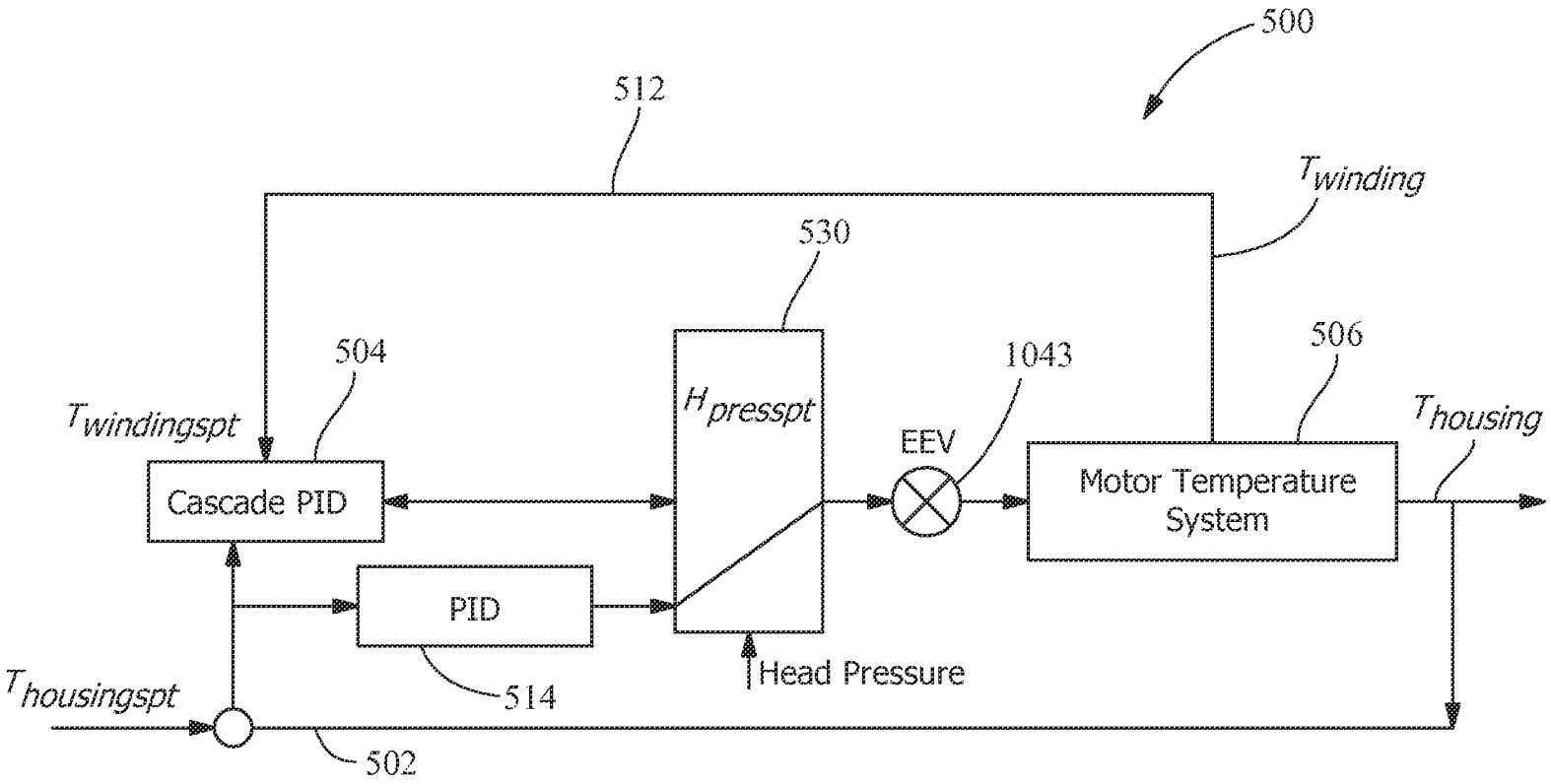
FIG. 5 depicts a hybrid control system for controlling motor temperature.

In another embodiment, shown in FIG. 5, a temperature control scheme is set forth that provides effective temperature control of the compressor motor over a full chiller operating head range. While the temperature control scheme depicted in FIG. 4 is useful in many applications, refrigeration systems, in particular, those utilizing centrifugal compressors and incorporating chiller systems sometimes experience some control problems utilizing a temperature control scheme such as shown in FIG. 4. Under high load conditions, such as in hot conditions when the compressor is operating at full load and high chiller head occurs, in conditions in which chiller load is increasing, monitoring the temperature of the stator windings $T_{winding}$ and controlling the motor housing temperature using this parameter is appropriate since $T_{winding}$ responds quickly to stator temperature changes which may otherwise lead to overheating of the motor under high load conditions. However, under low load conditions, the compressor is not required to operate at full capacity. In these low load conditions, compressor pressure is reduced, for example to prevent compressor surge in centrifugal compressors, as cooling load decreases. The reduced pressure also results in lower power consumption. In high thermal inertia systems, when load is reduced resulting in lower power consumption, the system is capable of handling heat dissipation resulting from the compressor operating at reduced power with little or no additional cooling. In this circumstance, utilizing stator winding temperature $T_{winding}$ in a cascade system such as depicted in FIG. 4 to control motor housing cooling may result in unstable cooling control and may lead to overcooling of the motor housing.

The control system in FIG. 5 utilizes two controllers, a standalone PID controller 514 and a cascade PID controller 504, but the arrangement of the PID controllers is different from the arrangement depicted in FIG. 4. Both standalone PID controller 514 and cascade PID controller 504 monitor the temperature of the motor housing $T_{housing}$ and its relation to the motor housing temperature setpoint $T_{housingspt}$. A signal indicative of the motor housing temperature measured by a motor housing sensor attached to the motor housing is transmitted via primary PID loop 502 to each of the controllers 504, 514. In addition, cascade PID controller 504 also monitors the measured temperature of the stator windings $T_{winding}$ as determined by a motor windings temperature sensor attached to the stator winding and its relation to a $T_{windingspt}$. Both cascade PID controller 504 and standalone PID controller 514 are in communication with a control output selector 530. Control output selector also receives a signal from a pressure sensor or transducer indicative of head pressure $H_{press}$, the pressure difference between the condenser and the evaporator pressures. It will be understood by those skilled in the art that although cascade PID controller 504, standalone PID controller 514 and control output selector 530 are depicted as separate components in the control system of FIG. 5, these components may be combined as different modules or programs performing their functions within a single master controller or computer.

Control output selector 530 also includes a head pressure setpoint $H_{pressspt}$ which is programmed into control output selector 530. Head pressure setpoint $H_{pressspt}$ may be modified as desired. Thus, if control output selector includes a program (or is a program within a master controller), the control output selector program may be reprogrammed to modify the head pressure setpoint. When the measured head pressure $H_{press}$ is below the programmed head pressure setpoint $H_{pressspt}$, control output selector 530 determines that standalone PID controller should control the operation of EEV 1043, as shown in FIG. 5. Thus, when the measured head pressure $H_{press}$ is low, as determined by a comparison to the head pressure set point $H_{pressspt}$, the cooling of the motor is determined by the measured temperature of the housing $T_{housing}$ and its relationship to the housing temperature setpoint $T_{housingspt}$ and control of EEV resides with standalone PID controller 514 as depicted in FIG. 5. When the measured head pressure $H_{press}$ is high, as determined by a comparison to the head pressure set point $H_{pressspt}$, the cooling of the motor is determined not only by the measured temperature of the housing $T_{housing}$ and its relationship to the housing temperature setpoint $T_{housingspt}$ monitored by cascade PID controller 504, but also by the windings temperature $T_{winding}$ and its relationship to $T_{windingspt}$ (or amperage as discussed above with regard to FIG. 4). Thus, when head pressure is high (above the $H_{pressspt}$), control output selector 530 determines that standalone PID controller should control the operation of EEV 1043 and switches control of the EEV away from standalone PID 514 to cascade PID 504. Control of EEV in high head condition thus resides with cascade PID controller 504. In high head conditions, the system normally will react to changes in stator temperature (or amperage) which changes more quickly than motor housing temperature. In cascade PID controller 504, the programming of any or all of $T_{housingspt}$, $T_{windingspt}$ and $H_{pressspt}$ may be modified as required if cooling is unsuitable to maintain the motor within desired temperature range. In FIG. 5, motor temperature system 506 includes head pressure sensor(s) as well as motor housing temperature sensor (s) and stator windings temperature sensor(s). Of course, the programmability of the system allows the cooling controls to be reprogrammed seasonally as desired with changing atmospheric conditions without having to shut down the entire cooling system.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for controlling temperature of a compressor motor (170) having a motor cooling circuit, the compressor motor (170) in a refrigeration circuit (1014) comprising a compressor (1020) having a motor (170), a condenser (1030) in fluid communication with the compressor (1020), a first expansion valve (1040) in fluid communication with the condenser (1030), an evaporator (1050) in fluid communication with the first expansion valve (1040) and in fluid communication with the compressor (1020), the motor cooling circuit comprising a second expansion valve (1043) in fluid communication with the condenser (1030) and the compressor motor (170), the compressor motor (170) further being in fluid communication with the refrigeration circuit (1014) between downstream of the first expansion valve (1040) and a compressor inlet, wherein the compressor motor (170) further includes a stator (176) having windings and a rotor (178) mounted within a motor housing (174) and refrigerant fluid provided from the condenser (1030) to the motor cooling circuit as a cooling fluid through the second expansion valve (1043), wherein the improvement is characterized by:

providing a primary PID loop (402), the primary PID loop (402) including a compressor motor housing temperature sensor mounted on a motor housing surface, and a first PID controller (404) in communication with the motor housing temperature sensor, the first PID controller (404) further programmed with a motor housing temperature set point;

providing a secondary PID loop (412), the secondary PID loop (412) including a stator winding temperature sensor mounted on the stator windings and a second PID controller (414) in communication with the second expansion valve (1043) and the first PID controller (404), the second PID controller (414) further programmed with a stator winding temperature set point;

providing a signal indicative of the stator winding temperature to the second PID controller (414);

providing a signal indicative of the motor housing temperature to the first PID controller (404);

providing a signal from the second PID controller (414) to the second expansion valve (1043) regulating refrigerant flow to the motor cooling circuit when the stator winding temperature varies from the stator setpoint temperature;

providing a signal from the first PID controller (404) to the second PID controller (414) reprogramming the stator winding temperature setpoint, the stator winding temperature setpoint being dynamically calculated by the first PID controller (404) based on the signal from the motor housing temperature sensor indicative of the motor housing temperature and its variance from the motor housing temperature setpoint as a result of refrigerant flow to the motor cooling circuit.

2. The method of claim 1 wherein the step of providing a refrigeration circuit (1014) comprising a compressor (1020) having a motor further comprises providing a compressor selected from the group consisting of a centrifugal compressor, a screw compressor and a scroll compressor.

3. The method of claim 1 wherein the step of providing a motor cooling circuit that includes the compressor motor (170) including a stator (176) having windings and a rotor (178) mounted within a motor housing (174), further includes a spacer (180) positioned within the housing (174) and between the housing (174) and the stator (176).

4. The method of claim 3 wherein the motor housing (174) further includes a helical annulus (182) providing a fluid passageway from the motor inlet through the motor housing (174) for refrigerant.

5. The method of claim 3 wherein the spacer (182) comprises a highly thermally conductive material.

6. The method of claim 1 wherein the step of providing a motor cooling circuit further includes a motor cooling circuit in first fluid communication with the refrigeration circuit (1014) providing refrigerant liquid to the evaporator (1050) and in second fluid communication with the refrigerant circuit (1014) providing refrigerant gas to the evaporator (1050).

7. The method of claim 1 wherein the step of providing a signal indicative of the stator winding temperature to the second PID controller (414) is a stator winding temperature from a temperature sensor mounted on the stator windings.

8. The method of claim 1 wherein the step of providing a signal indicative of the stator winding temperature to the second PID controller (414) is an amperage drawn by the stator windings measured by a stator winding amperage meter.

9. A system for cooling a compressor motor in a refrigeration system (1014), the refrigeration system having a compressor (1020) driven by a motor (170) further comprising a stator (176) and windings positioned within a motor housing (174), a condenser (1030) in fluid communication with the compressor (1020), a first expansion valve (1040) in fluid communication with the condenser (1030), an evaporator (1050) in fluid communication with the first expansion valve (1040) and in fluid communication with the compressor (1020) and a motor cooling circuit further including a second expansion valve (1043) in fluid communication with the condenser (1030) and the compressor motor (170), the compressor motor further being in fluid communication with the refrigeration system (1014) between downstream of the first expansion valve (1040) and a compressor inlet, wherein the system is further characterized by:

a primary PID loop (402), the primary PID loop (402) including a compressor motor housing temperature sensor mounted on a surface of the motor housing, and a first PID controller (404) programmed with a motor housing temperature set point and in communication with the motor housing temperature sensor;

a secondary PID loop (412), the secondary PID loop (412) including a stator winding temperature measurement indicator and a second PID controller (414) in communication with the second expansion valve (1043) and with the first PID controller (404), the second PID controller (414) further programmed with a stator winding temperature measurement indicator set point;

the second PID controller (414) being in communication with the second expansion valve (1043) in response to a signal from the stator winding temperature measurement indicator to regulate a flow of refrigerant to the motor cooling circuit when the stator winding temperature measurement indicator indicates that the stator winding temperature varies from the stator winding temperature indicator set point;

the first PID controller (404) in communication with the motor housing temperature sensor and the second PID controller (414), the first PID controller (404) reprogramming the stator winding temperature indicator set point of second PID controller (414) based on the temperature of the motor housing (174) and its variance from the motor housing temperature setpoint as a result of refrigerant flow to the motor cooling circuit.

10. The system of claim 9 wherein the stator winding temperature measurement indicator is an amperage sensor measuring the current drawn by the stator windings.

11. The system of claim 9 wherein the stator winding temperature measurement indicator is a temperature sensor mounted on the windings.

12. The system of claim 9 wherein the compressor motor further includes a spacer positioned between the motor housing and the stator.

13. The system of claim 12 wherein the motor housing further includes as a passageway for refrigerant, a helical annulus (182) opposite the stator (176).

14. The system of claim 9 wherein the motor cooling circuit further includes a liquid outlet in communication with the evaporator (1050), the liquid outlet providing liquid refrigerant to the evaporator (1050).

15. The system of claim 14 wherein the motor cooling circuit further includes an annulus (202) between the stator (176) and a motor rotor (178) and a vent in communication with the evaporator (1050), refrigerant passing through the annulus (202) and providing further motor cooling before returning to the evaporator (1050).

16. A system for cooling a compressor motor in a refrigeration system (1014), the refrigeration system having a compressor (1020) driven by a motor (170) further comprising a stator (176) and windings positioned within a motor housing (174), a condenser (1030) in fluid communication with the compressor (1020), a first expansion valve (1040) in fluid communication with the condenser (1030), an evaporator (1050) in fluid communication with the first expansion valve (1040) and in fluid communication with the compressor (1020) and a motor cooling circuit further including a second expansion valve (1043) in fluid communication with the condenser (1030) and the compressor motor (170), the compressor motor further being in fluid communication with the refrigeration system (1014) between downstream of the first expansion valve (1040) and a compressor inlet, wherein the system is further characterized by:

a control output selector (530) in communication with the expansion valve (1043);

a motor temperature system (506), the motor temperature system including a refrigeration system pressure sensor monitoring pressure difference between the condenser and the evaporator in communication with the control output selector; a motor housing temperature sensor mounted on a surface of the motor housing and a stator windings temperature sensor mounted on stator windings;

a cascade PID controller (504) in communication with the stator windings temperature sensor and the motor housing temperature sensor of the motor temperature system, the cascade PID controller further in selective communication with the control output selector (530), the cascade PID controller further programmed with a stator winding temperature set point;

a standalone PID controller (514) in communication with the motor housing temperature sensor of the motor temperature system, the standalone PID controller further in selective communication with the control output selector (530), the cascade PID controller further programmed with a motor housing temperature set point;

a first PID loop (502), the first PID loop (502) providing communication between the motor temperature system (506), the standalone PID controller (514) and the cascade PID controller;

a second PID loop (512), the second PID loop (412) providing communication between the motor temperature system (506) and the cascade PID controller (504);

wherein the control output selector provides selectable communication between the cascade PID controller (504) and the standalone PID controller (514) based on the pressure measured the refrigeration pressure sensor.

* * * * *